United States Patent [19]

Domyan

[11] 4,185,507

[45] Jan. 29, 1980

[54] ACCELERATION RESPONSIVE TRIPPING MECHANISM

[75] Inventor: Frank F. Domyan, Canoga Park, Calif.

[73] Assignee: Koso Service Co., Ltd., Toda, Japan

[21] Appl. No.: 860,146

[22] Filed: Dec. 14, 1977

[51] Int. Cl.[2] ..... G05G 17/00; H01H 35/02; H01H 35/14

[52] U.S. Cl. ..... 74/2; 200/61.45 R; 200/61.52

[58] Field of Search ..... 74/2; 200/61.45 R, 61.52; 137/38, 45

[56] References Cited

U.S. PATENT DOCUMENTS

| | | | |
|---|---|---|---|
| 2,017,274 | 10/1935 | Breitenstein | 200/61.52 |
| 2,206,067 | 7/1940 | Waltamath | 200/61.45 R |
| 2,927,982 | 3/1960 | Slough | 200/61.52 X |
| 3,878,858 | 4/1975 | Yamada | 200/61.45 R X |
| 4,007,643 | 2/1977 | Matsushita | 74/2 |

*Primary Examiner*—Allan D. Herrmann
*Attorney, Agent, or Firm*—Wills, Green & Mueth

[57] ABSTRACT

An acceleration responsive tripping mechanism which employs the use of a weighted ball which rests upon a pedestal when in the at rest position. Upon movement of the ball from the pedestal, the ball will contact a suspended member which is subsequently moved causing activation of an actuation means.

14 Claims, 4 Drawing Figures

Fig. 2
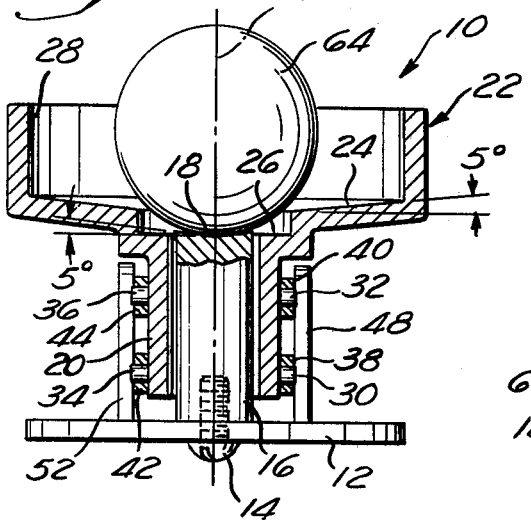
Fig. 1
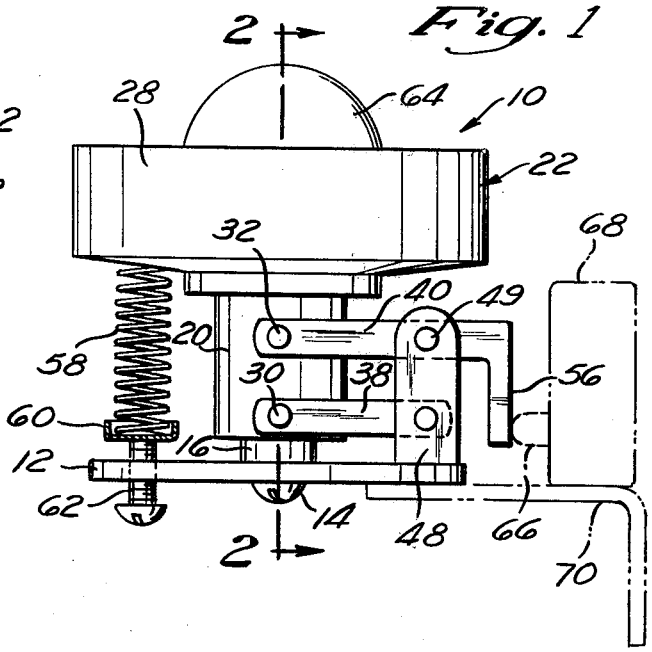
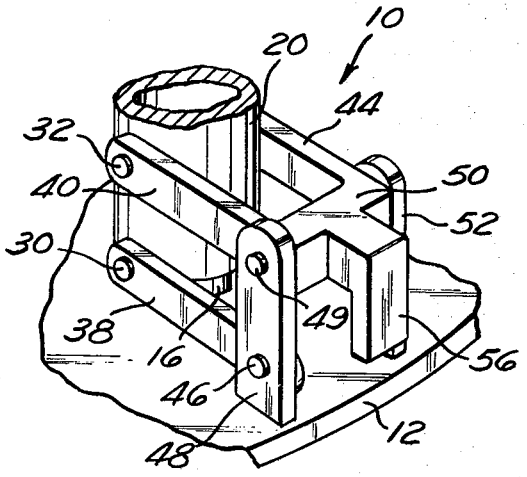
Fig. 4
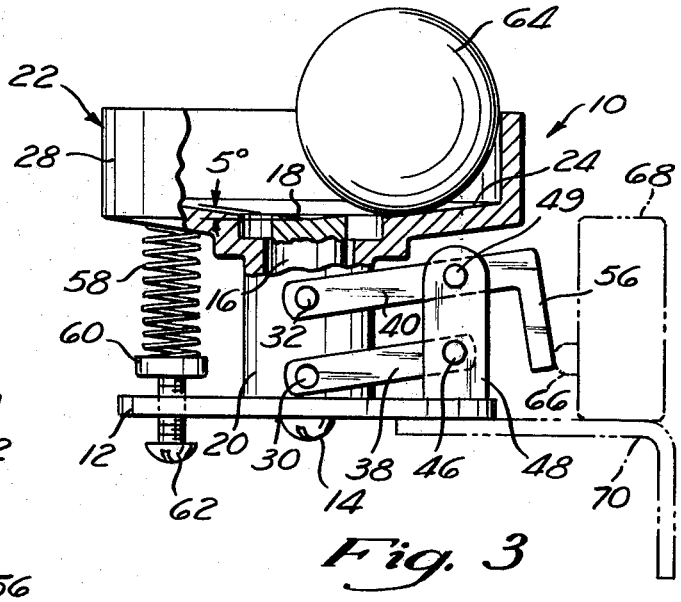
Fig. 3

ACCELERATION RESPONSIVE TRIPPING MECHANISM

BACKGROUND OF THE INVENTION

The field of this invention relates to acceleration responsive tripping mechanisms and more particularly to a tripping mechanism which is designed primarily for use in conjunction with an unanticipated shock such as which is incurred in an earthquake.

Acceleration tripping mechanisms have in the past been constructed and used for numerous purposes. One common purpose of such a mechanism is that upon the mechanism receiving an unexpected shock, that the mechanism functions to activate a switch or a valve to operate or shut down a form of electrical apparatus such as a motor or effect closing of a conduit such as a gas line. A common form of unexpected shocks are what may be incurred by an earthquake. In an earthquake situation, an acceleration tripping mechanism may be employed to effect closing of a gas line so as to prevent a leakage of gas and possibly a fire or an explosion. A common use of such an acceleration tripping mechanism would be within a conventional household wherein the acceleration tripping mechanism would activate a valve which would close the gas line to the house upon an earthquake having occurred.

Previously the acceleration tripping mechanisms of the prior art had been quite complex in construction and therefore extremely expensive to manufacture. The complexity usually arises from the designing of the mechanism so as to be operable upon the mechanism receiving shock from any direction and also being equally sensitive from any direction. Such mechanisms of the past have been more sensitive in a horizontal plane than in a vertical plane.

SUMMARY OF THE INVENTION

The primary objective of this invention is to construct an acceleration tripping mechanism which is constructed of few parts and which is equally sensitive to a shock force from any given direction. Because the mechanism of this invention is constructed of few parts, the manufacturing costs are substantially lower than heretofore possible than with previous types of acceleration response tripping mechanisms.

The mechanism of this invention comprises a base to which is attached a pedestal or upstanding elongated member. The free outer end of the elongated member is recessed into an inverted cone shape. The side walls of the inverted cone are inclined at a small inclination with respect to horizontal such as five degrees. A weight such as a steel ball is to assume an at rest position within the recess. A member surrounds the elongated member and is located in a suspended relation thereto. Upon the mechanism incurring a shock of sufficient magnitude, the ball moves from the recess and contacts the suspended member. The suspended member is therefore caused to move in relation to the elongated member. Movement of the suspended member causes movement of an actuation means which in turn can be employed to activate a switch or valve or other similar type of structure.

BRIEF DESCRIPTION OF THE DRAWING

FIG. 1 is a side elevational view of the acceleration responsive tripping mechanism of this invention showing how the mechanism would be employed to effect activation of an actuation means such as an electrical switch;

FIG. 2 is a cross sectional view of the mechanism of this invention taken along line 2—2 of FIG. 1;

FIG. 3 is a view similar to FIG. 1 but showing the mechanism in the activating position; and FIG. 4 is a segmental isometric view of the linkage assembly and actuation means which are employed to support the suspended member within the mechanism of this invention.

DETAILED DESCRIPTION OF THE SHOWN EMBODIMENT

Referring particularly to the drawing, there is shown the acceleration tripping mechanism 10 of this invention which includes a fixed base 12. The base 12 includes an opening therein through which a fastener 14 is conducted. The fastener 14 is fixedly secured to a pedestal or elongated member 16. The member 16 is shown to be substantially in the shape of a cylinder. However, it is deemed to be within the scope of this invention that any desireable shape could be employed.

The free outer end of the member 16 is formed into a recess 18 which is basically in the shape of an inverted cone. The sidewalls of the recess are inclined at a slight angle with respect to horizontal. A typical angle would be five degrees. The smaller the angle, the more responsive the mechanism to lower shock levels. The greater the angle, the greater the force of the shock required in order to activate the mechanism 10.

Located about the elongated member 16 in a spaced relationship therefrom but in close proximity thereto is a tubular extension 20. Member 20 is connected to a large cup shaped member 22. The cup shaped member 22 has an interior chamber the bottom of which is formed by a contactable surface 24. The surface 24 is located about the recess 18. The contactable surface 24 is spaced slightly from recess 18 due to the inclusion of annular cut-out section 26. The reason for the cut-out section 26 will be explained further on in this specification.

The contactable surface 24 is inclined with respect to horizontal. This inclination will preferably be at the same inclination of the sidewalls of the recess 18. In other words if five degrees is a preferred inclination of the sidewalls of the recess 18, then the inclination with respect to horizontal of the contactable surface 24 will also be five degrees. Again, the reason for this will be explained further on in this specification.

The contactable surface 24 terminates at an upstanding annular wall 28. The function of the wall 28 will also be explained further on in the specification.

The tubular member 20 includes a first pair of vertically disposed pivot pins 30 and 32. Similarly and diametrically located opposite the tubular member 20 and in respective alignment with each other are a second pair of pivot pins 34 and 36. A first link 38 is pivotally mounted upon the pivot pin 30 with a second link 40 being pivotally mounted upon the pivot pin 32. Similarly a link 42 is pivotally mounted upon the pin 34 with a link 44 being pivotally mounted upon the pin 36. The unattached end of the link 38 is pivotally mounted by means of a pin 46 to a member 48. The member 48 is fixedly mounted upon the base 12. The unattached end of the link 40 is integrally connected through an appex member 50 to link 44 forming a bifurcate assembly with the links 40 and 44 comprising a pair of spaced apart parallel leg members. The apex member 50 is pivotally supported by a pivot pin 49 between the member 48 and also a member 52 which is fixedly mounted on the base 12. The link 42 is also pivotally mounted upon the member 50 (not shown).

It is to be noted that the links 40 and 38 are located parallel and similarly the links 40 and 42 are located parallel. Due to this parallel relationship, the movement of the tubular member 20 in respect to the member 16 is in a direction always parallel to the longitudinal center axis 54 of the member 16.

Integrally attached to the member 50 is an L shaped member 56, the function of which will be explained further on in the specification.

A compression spring 58 is attached at one end to the underside of the cup shaped member 52 and the other end of the spring 58 is located within spring retainer 60. The spring retainer 60 is attached to a screw fastener 62 which is threadably received within an opening formed in the base 12. By loosening or tightening of the screw fastener 62, the compression force of the spring 58 is varied. Prior to the operation of the mechanism 10 of this invention, the fastener 62 is adjusted so the force of the spring 58 is such that the members 22 and 20 are located in a suspended position as is shown in FIGS. 1 and 2 of the drawing. This suspended position is so that the bottom edge of the member 20 is spaced above the base 12.

A weighted mass such as a metallic ball 64 is to be supported within the recess 18 such as is shown in FIGS. 1 and 2 of the drawing.

The operation of the mechanism 10 of this invention is as follows: The mechanism 10, when in the at rest position shown in FIGS. 1 and 2, the ball 64 is located within the recess 18. The center of the ball 64 coincides with the longitudinal center axis 54. In this at rest position, the members 22 and 20 are located within a suspended condition above the base 12 and the L shaped member 56 is positioned against some form of actuation means such as an electrical switch 66 of a switch mechanism 68. Switch mechanism 68 is to be fixedly mounted upon a mounting bracket 70 and also the plate 12 may be fixed to the bracket 70. The switch 66 is in an inoperable position within FIGS. 1 and 2.

Upon the mechanism 10 incurring an unexpected shock of sufficient magnitude, the ball 64 will proceed to roll upon the inclined surface of the recess 18. The rolling motion of the ball 64 will continue until the ball proceeds to contact the inner edge of the contactable surface 24. The cut-out section 24 is provided so as to prevent the contactable surface 24 from contacting the ball 64 when in the normally at rest position. Since the inclination of the surface 24 is equal to the inclination of the side wall of the recess 18, the movement of the ball 64 after it leaves the recess 18 will be moving at the same grade of incline as the incline of the recess 18. This means that if the mechanism 10 is encountered with the precise minimum force acquired to dislodge the ball 64 from the recess 18, that the ball 64 will move against the same degree of incline upon the contactable surface 24. Therefore, the contactable surface 24 functions at the same force level to dislodge the ball 24 as the recess 18.

The ball 64 will proceed to move upon the contactable surface 24 until it contacts the wall 28. However, by this time the weight of the ball 64 has been sufficient to overcome the compression of the spring 58 and move the tubular member 20 downward against the base 12. This movement causes the pivoting of the L shaped member 56 to a canted position which causes activation of the switch 66. The mechanism 10 at this particular point has then functioned as is desired.

After the shock force has dissipated, the ball 64 will automatically reposition itself upon the recess 18. When this occurs, the members 20 and 22 will be again moved to the suspended position by means of the spring 58. In other words, the mechanism 10 of this invention has automatically reset itself.

It is to be understood that the mechanism 10 will be constructed so that small shock levels below a certain magnitude level will not affect the mechanism 10.

What is claimed is:

1. An acceleration responsive tripping mechanism comprising:

a base;

an elongated member attached to said base and having a free outer end;

a movable mass normally at rest on said free outer end of said elongated member and retained thereon by the force of gravity;

an annular means located about said free outer end and having a contactable surface surrounded by a confining means preventing movement of said movable mass beyond the periphery of said contactable surface;

means for mounting said annular means to said base substantially coaxially with said elongated member for reciprocating movement along said elongated member;

means for urging said annular means upwardly, suspending said annular means relative to said elongated member;

actuation means connected to said annular means such that upon said movable mass being moved upon said contactable surface said annular means is moved downwardly relative to said elongated member causing activation of said actuation means.

2. The mechanism defined in claim 1 wherein said free outer end of said elongated member is recessed, the center of said recess coinciding with the longitudinal center axis of said elongated member; said recess is in the shape of an inverted cone, the side walls of said inverted cone being inclined at approximately five degrees in respect to a line perpendicular to said longitudinal center axis; and said contactable surface is a planar surface inclined at an angle equal to the inclination of said recess of said free outer end, said contactable surface being annularly disposed about said free outer end.

3. The mechanism defined in claim 1, wherein said mounting means comprises a linkage assembly connecting said annular means to an upstanding support member rigidly mounted to said base; and said urging means comprises a spring assembly located between said annular means and said base, the force of said spring assembly counterbalancing the inherent weight of said annular means and said linkage assembly to suspend said annular means in a position spaced from said base.

4. The mechanism defined in claim 3, wherein said linkage assembly comprises a parallel linkage arrangement.

5. The mechanism defined in claim 4, wherein said actuation means is rigidly secured to said linkage arrangement.

6. An acceleration responsive tripping mechanism comprising:

a base;

an elongated member attached to said base, said elongated member having a free outer end, said elongated member having a longitudinal center axis;

a movable mass normally at rest on said free outer end of said elongated member, said elongated member being positioned so said movable mass will be maintained upon said free outer end by the force of gravity;

a first member located directly adjacent said elongated member;

a second member located about said free outer end and operatively engaged with said first member, said second member having a contactable surface, a confining means attached at the periphery of said contactable surface, said movable mass being capable of moving upon said contactable surface with said confining means preventing movement of said movable mass beyond the periphery of said contactable surface;

a first means comprising a linkage assembly connecting said first member to an upstanding support member, said upstanding support member being fixedly mounted to said base, said first means further including a spring assembly located between said second member and said base, the force of said spring assembly to counterbalance the inherent weight of said first member and said second member and said linkage assembly to effect suspension of said first and second members in a position spaced from said base; and actuation means connected to said first member, upon said movable mass being moved upon said contactable surface said first member is moved relative to said elongated member causing activation of said actuation means.

7. The mechanism defined in claim 6, wherein said free outer end of said elongated member is recessed, the center of said recess coinciding with said longitudinal center axis of said elongated member.

8. The mechanism defined in claim 7, wherein said recess is in the shape of an inverted cone, the side walls of said inverted cone being inclined at approximately five degrees in respect to a line perpendicular to said longitudinal center axis.

9. The mechanism defined in claim 8, wherein said contactable surface is a planar surface inclined at an angle equal to the inclination of said recess of said free outer end, said contactable surface being annularly disposed about said free outer end.

10. The mechanism defined in claim 6, wherein said linkage assembly comprises a parallel linkage arrangement.

11. The mechanism defined in claim 10, wherein said actuation means is fixedly secured to said linkage arrangement.

12. The mechanism as defined in claim 11, wherein said movable mass comprises a ball.

13. The mechanism defined in claim 11, wherein said free outer end of said elongated member is recessed, the center of said recess coinciding with said longitudinal center axis of said elongated member; said recess is in the shape of an inverted cone, the side walls of said inverted cone being inclined at approximately five degrees in respect to a line perpendicular to said longitudinal center axis; and said contactable surface is a planar surface inclined at an angle equal to the inclination of said recess of said free outer end, said contactable surface being annularly disposed about said free outer end.

14. The mechanism defined in claim 13, wherein said movable mass comprises a ball.

* * * * *